US009227147B2

(12) United States Patent
Kim

(10) Patent No.: US 9,227,147 B2
(45) Date of Patent: Jan. 5, 2016

(54) MAGNET-MOUNTED PARTS AND MAGNET TOY INCLUDING SAME

(71) Applicants: SYNTHIA JAPAN CO., LTD., Tokyo (JP); KAJIN GROUP PTE. LTD., Singapore (SG)

(72) Inventor: Sang Hoon Kim, Seoul (KR)

(73) Assignees: Synthia Japan Co., Ltd., Tokyo (JP); Kajin Group Pte. Ltd., Singapore (SG)

( * ) Notice: Subject to any disclaimer, the term of this patent is extended or adjusted under 35 U.S.C. 154(b) by 0 days.

(21) Appl. No.: 14/369,681

(22) PCT Filed: Dec. 21, 2012

(86) PCT No.: PCT/KR2012/011221
§ 371 (c)(1),
(2) Date: Jun. 27, 2014

(87) PCT Pub. No.: WO2013/100491
PCT Pub. Date: Jul. 4, 2013

(65) Prior Publication Data

US 2015/0004869 A1 Jan. 1, 2015

(30) Foreign Application Priority Data

Dec. 28, 2011 (KR) ..... 10-2011-0144338
Mar. 14, 2012 (KR) ..... 10-2012-0026217
Mar. 23, 2012 (KR) ..... 10-2012-0029789

(51) Int. Cl.
*A63H 33/04* (2006.01)
*A63H 33/10* (2006.01)
*H01F 7/02* (2006.01)

(52) U.S. Cl.
CPC ..... *A63H 33/046* (2013.01); *A63H 33/10* (2013.01); *H01F 7/0221* (2013.01)

(58) Field of Classification Search
CPC ..... A63H 33/04; A63H 33/046; A63H 33/26
USPC ..... 446/92, 129, 131, 138
See application file for complete search history.

(56) References Cited

U.S. PATENT DOCUMENTS 3,254,440 A * 6/1966 Duggar ..... 446/92
3,375,604 A * 4/1968 Alonso ..... 446/92

(Continued)

FOREIGN PATENT DOCUMENTS

KR 10-0695293 B1 3/2007
KR 10-2009-0046429 A 5/2009

(Continued)

OTHER PUBLICATIONS

PCT International Search Report for PCT Counterpart Application No. PCT/KR2012/011221, 5 pgs., (Apr. 29, 2013).

(Continued)

*Primary Examiner* — Michael Dennis
*Assistant Examiner* — Urszula M Cegielnik
(74) *Attorney, Agent, or Firm* — Blakely, Sokoloff, Taylor & Zafman LLP

(57) ABSTRACT

The present invention relates to the field of toys, and more specifically, to a magnet-mounted part for mounting a magnet and a magnet toy. Particularly, the present invention provides a magnet-mounted part comprising: a magnet mounting unit on which a magnet is mounted, and which has a saw-toothed wheel engaged with the magnet-mounted part on which an external magnet is mounted, an accommodation unit which accommodates the magnet-mounted unit therein, and has an opening portion such that the saw-toothed wheel of the magnet-mounted unit can be exposed; and a One rotation angle-adjusting unit which is provided to rotate in engagement with the magnet-mounted unit and the accommodation unit, and is formed such that the unit rotation intervals thereof are smaller than the toothed intervals of the saw-toothed wheel of the magnet-mounted unit.

18 Claims, 6 Drawing Sheets

(56) References Cited

U.S. PATENT DOCUMENTS

| | | | | |
|---|---|---|---|---|
| 5,362,271 | A * | 11/1994 | Butt | 446/139 |
| 5,746,638 | A * | 5/1998 | Shiraishi | 446/92 |
| 6,097,272 | A * | 8/2000 | Grover et al. | 335/207 |
| 6,749,480 | B1 * | 6/2004 | Hunts | 446/92 |
| 7,413,493 | B2 * | 8/2008 | Toht et al. | 446/92 |
| 7,520,793 | B2 * | 4/2009 | Pillai et al. | 446/97 |
| 7,942,718 | B2 * | 5/2011 | Tenorio | 446/92 |
| 8,070,550 | B2 * | 12/2011 | Song et al. | 446/92 |
| 8,128,452 | B2 * | 3/2012 | Kim et al. | 446/92 |
| 2006/0046605 | A1 | 3/2006 | Piretti | |
| 2006/0111010 | A1 * | 5/2006 | Park | 446/92 |
| 2012/0270465 | A1 * | 10/2012 | Park | 446/129 |

FOREIGN PATENT DOCUMENTS

| | | | |
|---|---|---|---|
| KR | 10-0954429 | B1 | 4/2010 |
| KR | 10-2011-0026895 | A | 3/2011 |
| KR | 2011-0026896 | A | 3/2011 |
| KR | 10-1032609 | B1 | 4/2011 |
| KR | 20110070214 | A | 6/2011 |
| KR | 10-2011-0126909 | A | 11/2011 |
| KR | 101227652 | B1 | 1/2013 |

OTHER PUBLICATIONS

PCT International Preliminary Report on Patentability for PCT Application No. PCT/KR2012/011221, 5pgs (Jul. 1, 2014).

* cited by examiner

MAGNET-MOUNTED PARTS AND MAGNET TOY INCLUDING SAME

CROSS-REFERENCE TO RELATED APPLICATIONS

This patent application is a U.S. National Phase Application under 35 U.S.C. §371 of International Application No. PCT/KR2012/011221, filed Dec. 21, 2012, entitled MAGNET-MOUNTED PARTS AND MAGNET TOY INCLUDING SAME, which claims priority to Korean Patent Application No. 10-2011-0144338, filed Dec. 28, 2011, Korean Patent Application No. 10-2012-0026217, filed Mar. 14, 2012, and Korean Patent Application No. 10-2012-0029789, filed Mar. 23, 2012

FIELD

The present invention relates to the field of toys, and more particularly, a magnet-mounted part for mounting a magnet and a magnet toy.

BACKGROUND

In recent time, various types of magnet toys, as toys for encouraging creativities of infants or small children, are developed such that the children can assemble several blocks using magnets to joyfully make buildings, cars, robots and the like.

The magnet toy is basically configured in a manner of mounting a magnet onto each surface of a toy main body such that toys can be freely assembled to each other by a mutual attachment (attraction) between the magnets.

However, the magnetic coupling using the magnets is merely achieved by a surface-to-surface contact between blocks. Accordingly, the coupling is instable. Consequently, the magnet-mounted toys may have several disadvantages of, for example, easy destroy while assembling the toys or playing with a completely-assembled toy, being tired of easily disassembled or destroyed toys depending on ages, and the like.

Therefore, a method of more inspiring creative abilities of infants is continuously required.

PRIOR ART DOCUMENT

Patent Document

Korean Patent Publication No. 10-2011-0026896 (Mar. 16, 2011) "Rotation magnet mounting opening for magnet toy"

Korean Patent Registration No. 10-0954429 (Apr. 15, 20(10)) "Magnet mounting structure for magnet toy"

Korean Patent Registration No. 10-1032609 (Apr. 26, 2011) "Structure of magnet block for toy"

SUMMARY

The present invention has been made keeping in mind the drawbacks of the related art, and an object of the invention is to provide a magnet-mounted part capable of allowing assembling by magnetic coupling and toothed engagement (saw-tooth engagement), and a magnet toy having the same.

Another object of the invention is to provide a magnet-mounted part capable of increasing assembly completion of block toys by enabling a minute adjustment of an engagement between saw-teeth, and a magnet toy having the same.

In order to achieve the above objects, there is provided a magnet-mounted part (30) including: a magnet mounting unit (40) to which a magnet (10) is mounted and which has a saw-toothed wheel (42) engaged with a magnet-mounted part having an external magnet; an accommodation unit (50) which accommodates the magnet mounting unit (40) therein and has an opening portion ((54)*a*) such that the saw-toothed wheel (42) of the magnet mounting unit (40) is exposed therethrough; and a fine rotation angle-adjusting unit (60) which is provided to rotate in engagement with the magnet mounting unit (40) and the accommodation unit (50), and is formed such that unit rotation intervals thereof are smaller than toothed intervals of the saw-toothed wheel (42) of the magnet mounting unit (40).

The magnet mounting unit (40) may be formed in a shape of a ring (annular shape). The magnet (10) may be mounted into a center of the annular magnet mounting unit (40), and the saw-toothed wheel (42) may be provided on each of both end surfaces of the magnet mounting unit (40) in an axial direction. The magnet mounting unit (40) may have a size large enough to rotate within an accommodation space (52*a*) such that the both end surfaces having the saw-toothed wheels (42) can be turned over.

The accommodation unit (50) may form the accommodation space (52*a*) for accommodating the magnet mounting unit (40) therein. The accommodation unit (50) may include a cylindrical portion (52) whose outer end surface of both end surfaces in an axial direction is opened, and an annular frame (54) disposed on the outer end surface of the cylindrical portion (52) to prevent separation of the magnet mounting unit (40) and form the opening portion (54*a*).

The fine rotation angle-adjusting unit (60) may include a fine adjustment saw-toothed wheel (62) formed on the annular frame (54) of the accommodation unit (50), and a saw-toothed protrusion (64) disposed on the magnet mounting unit (40) so as to be movable in engagement with the fine adjustment saw-toothed wheel (62) along a circumferential direction of the fine adjustment saw-toothed wheel (62).

The fine rotation angle-adjusting unit (60) may include a fine adjustment saw-toothed wheel (62) formed on the accommodation unit (50) and arranged coaxially with the saw-toothed wheel (42) of the magnet mounting unit (40), and a saw-toothed protrusion (64) disposed on the magnet mounting unit (40) so as to be movable in engagement with the fine adjustment saw-toothed wheel (62) along the circumferential direction of fine adjustment saw-toothed wheel (62).

The magnet-mounted part (30) may further include a stopper (70) which limits a range that the magnet mounting unit (40) rotates with respect to the accommodation unit (50), coaxially with the saw-toothed wheel (42).

The stopper (70) may include stopping jaws (71, 72, 73 and 74) which protrude in plurality from the accommodation unit (50) and between which the saw-toothed protrusions (64) of the magnet mounting unit (40) are inserted such that the magnet mounting unit (40) can be relatively rotated. The stopping jaws (71, 72, 73 and 74) may have intervals therebetween which are greater than toothed intervals of the saw-toothed wheels (42) of the magnet mounting unit (40).

The saw-toothed protrusions (64) disposed on the magnet mounting unit (40) may be provided as a pair facing each other based on a center of rotation. The plurality of stopping jaws (71, 72, 73 and 74) may be provided in a plurality of pairs in correspondence with the pair of saw-toothed protrusions 64. Intervals between the pairs of the stopping jaws (71, 72, 73 and 74) may be different from one another.

The fine rotation angle-adjusting unit (60) may include fine adjustment saw-tooth wheels (62) each provided between the stopping jaws (71, 72, 73 and 74) disposed on the accommodation unit (50) and arranged coaxially with the saw-tooth wheels (42) of the magnet mounting unit (40), and saw-toothed protrusions 64 disposed on the magnet mounting unit (40) so as to be movable in engagement with the fine-adjustment saw-toothed wheels (62) along a circumferential direction of the fine-adjustment saw-toothed wheels (62).

Also, in order to achieve the above objects, there is provided a magnet toy comprising: the aforementioned magnet-mounted parts 30; and a main body (20) which is provided with part installation recesses (22) in which the magnet-mounted parts (30) are installed.

The main body (20) may be implemented as a polygonal block.

The accommodation unit (50) of the magnet-mounted part (30) may further include a wedge portion (56) which outwardly protrudes from an end of an inner end surface of the cylindrical portion (52) to be stuck into the main body (20).

The present disclosure may enable toys to be more firmly assembled to each other by allowing magnetic coupling by virtue of magnets and engagement coupling by virtue of saw-teeth. Specifically, the engagement between the saw-teeth may be complemented, which may allow for fine adjustment of a rotation angle, resulting in excellent assembly completion.

A scientific learning may be naturally provided to infants in response to the engagement of the saw-teeth, thereby encouraging creativities of the infants and bringing continuous interest.

In addition, even in case of no assembling between toys, a recess of an accommodation unit may be covered with a magnet mounting unit such that the accommodation unit can be shielded. This may prevent an introduction of foreign materials into the accommodation unit. Also, noise which is generated due to the magnet mounting unit being moved and collided with the accommodation unit can be prevented.

BREIF DESCRIPTION OF THE DRAWINGS

The following drawings are views of a magnet toy in accordance with the present disclosure.

DETAILED DECSRIPTION

Hereinafter, the present disclosure will be described in detail with reference to the accompanying drawings.

In describing the present invention, moreover, the detailed description will be omitted when a specific description for publicly known technologies to which the invention pertains is judged to obscure the gist of the present invention.

Figure 1:
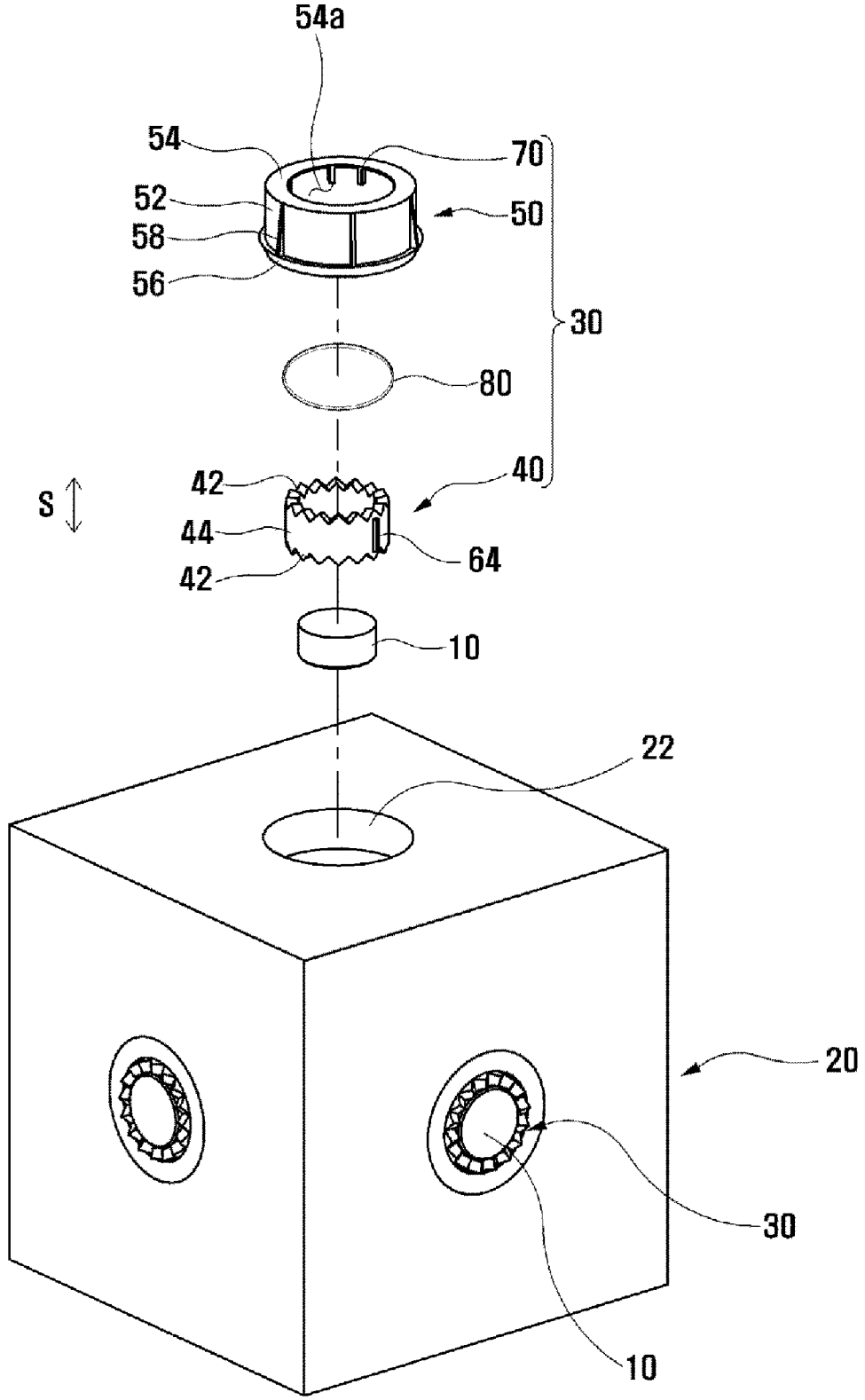
FIG. 1 is a perspective view illustrating a disassembled state of one magnet-mounted part from a main body.
Figure 2:
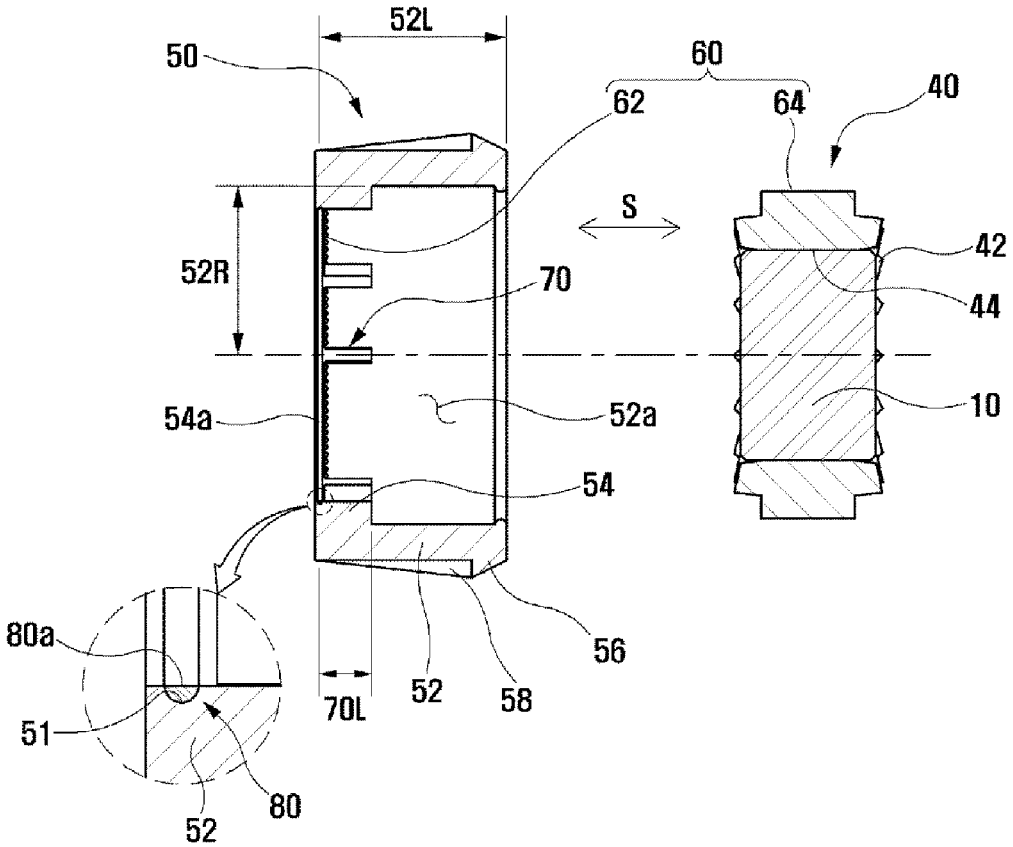
FIG. 2 is a sectional view illustrating the disassembled state of the magnet-mounted part.
Figure 3:
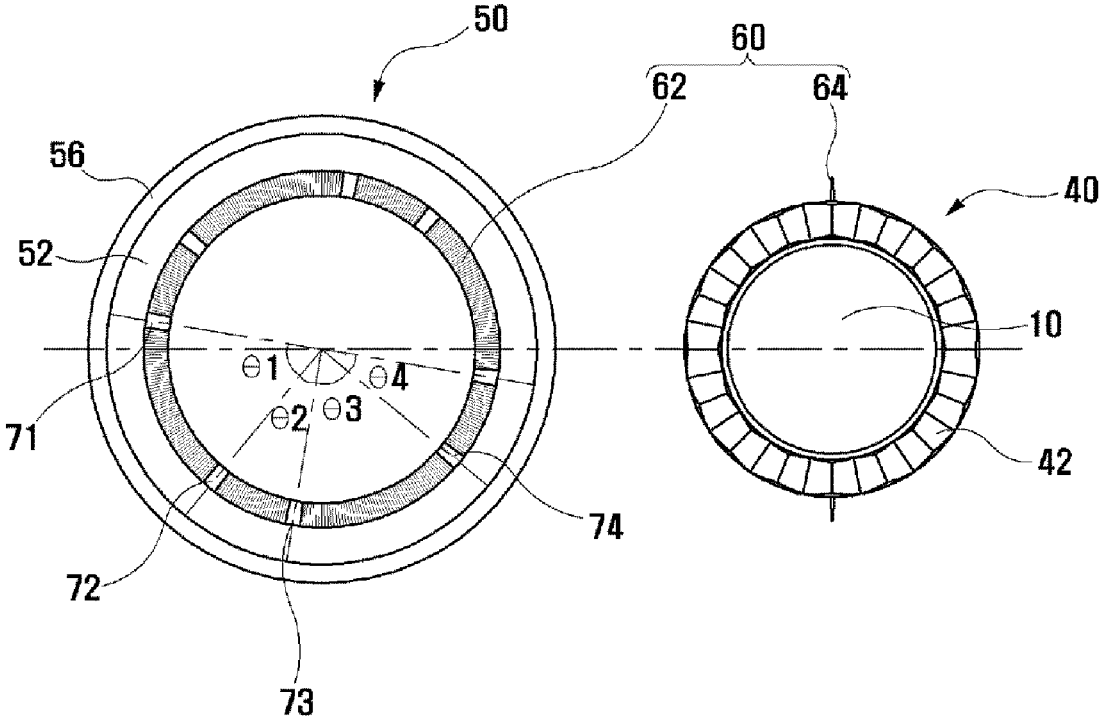
FIG. 3 is a planar view illustrating the disassembled state of the magnet-mounted part.
Figure 4:
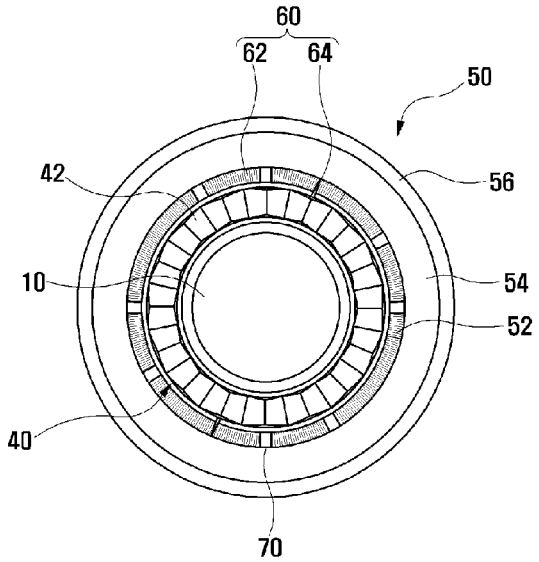
FIG. 4 is a planar view illustrating an assembled state of the magnet-mounted part.

As illustrated in FIG. 1 and the following drawings, a magnet toy disclosed herein may basically include a main body 20 on which magnets 10 are mounted.

The main body 20 may have various shapes or structures, such as a hexahedral shape, an oval shape, a cylindrical shape and the like. Here, the main body 20 may preferably be provided with at least one part-installation recess 22 in which a magnet-mounted part 30 to be explained later is fixedly inserted, such that the magnet 10 can be mounted thereto without being protruded. The part-installation recess 22 of the main body 20 may have a shape corresponding to a shape of an accommodation unit 50 of the magnet-mounted part 30, such that the magnet-mounted part 30 can be inserted therein without a gap.

The main body 20 may be formed of various materials, specifically, wood so as to be advantageous from the eco-friendly perspective.

The magnet 10 may be coupled to the main body 20 in a state of being mounted by the magnet-mounted part 30.

The magnet-mounted part 30 may specifically be configured to allow toys to be assembled to each other both in a magnetic coupling manner by the magnets 10 and in a toothed coupling manner.

To this end, the magnet-mounted part 30 may include a magnet mounting unit 40 to which the magnet 10 is mounted and which has a saw-toothed wheel, an accommodation unit 50 which accommodates the magnet mounting unit 40 therein and has an opening portion **54*a* such that the saw-toothed wheel 42 of the magnet mounting unit 40 is exposed therethrough; and a fine rotation angle-adjusting unit 60 which is provided to rotate in engagement with the magnet mounting unit 40 and the accommodation unit 50, and is formed such that unit rotation intervals thereof are smaller than toothed intervals of the saw-toothed wheel 42 of the magnet mounting unit 40**.

The magnet mounting unit 40 may basically be formed in a circular shape to be easily rotated in the accommodation unit 50. Specifically, the magnet mounting unit 40 may include an annular body portion 44, which has a central space for mounting the magnet 10 therein.

In particular, the annular body portion 44 may be formed to have a size large enough to be rotatable within the accommodation unit 50 such that both end surfaces thereof in an axial direction (arrow S) can be turned over. That is, all the magnets 10 have N-pole and S-pole. If the same poles face each other and apply repulsive forces against each other, it may disable the coupling between toys. Therefore, the coupling by the magnet 10 may preferably be achieved in a manner that the magnet mounting unit 40 having the magnet 10 mounted thereto is freely rotatable within the accommodation unit 50 by an attractive force of the magnet 10.

As the annular body portion 44 is formed in such a manner, the magnet 10 may be formed in a disc shape whose center of rotation is aligned with that of the magnet mounting unit 40 and which induces a smooth rotation of the magnet mounting unit 40. In order for the magnet 10 to come in contact with a magnet of another toy in a surface-to-surface manner, the magnet 10 may be divided into N-pole and S-pole in an axial direction or a radial direction.

In this manner, one of both end surfaces of the annular body portion 44 in the axial direction (arrow S) may be externally exposed through the opening portion 54*a* of the accommodation unit 50, by the magnetic force of the magnet 10. Accordingly, the saw-toothed wheel 42 provided on the annular body portion 44 may be formed on at least one of the both end surfaces of the annular body portion 44 in the axial direction (arrow S). Specifically, considering that the both end surfaces of the magnet mounting unit 40 along the axial direction are turned over within the accommodation unit 50 by the magnetic force of the magnet 10, the saw-toothed wheel 42 of the magnet mounting unit 40 may be provided on each of the both end surfaces of the annular body portion 44 along the axial direction (arrow S). Of course, the saw-toothed wheel 42 of the magnet mounting unit 40 may be formed in an annular shape whose center of rotation is aligned with that of the annular body portion 44, in correspondence with the annular body portion 44. That is, the saw-toothed wheel 42 may be provided with a plurality of saw-teeth formed along a circumferential direction of the annular body portion 44. Here, it may be better for those saw-teeth of the saw-toothed wheel 42 to have smaller (narrower) toothed intervals in view of a fine adjustment, but the toothed interval may preferably be about 5°, taking into account fabrication limits and the like. The saw-toothed wheel 42 may be integrally formed with the annular body portion 44, or integrally coupled with the annular body portion 44 after separately fabricated.

The accommodation unit 50 may form an accommodation space 52*a* for accommodating the magnet mounting unit 40 therein. The accommodation unit 50 may include a cylindrical portion 52 formed in a cylindrical shape to have a circular structure to correspond to the circular structure of the magnet mounting unit 40. Of both end surfaces of the cylindrical portion 52 along an axial direction, an outer end surface thereof exposed out of the part-installation recess 22 of the main body 20 may be formed open, such that the saw-toothed wheel 42 of the magnet mounting unit 40 can be externally exposed to be engaged with a saw-toothed wheel of another toy. The cylindrical portion 52 may also be formed in a manner that the other end surface of the both end surfaces thereof along the axial direction, namely, an inner end surface thereof is formed open. Accordingly, the magnet mounting unit 40 may be inserted and accommodated in or separated from the cylindrical portion 52 through the open inner end surface of the cylindrical portion 52. In order for the magnet mounting unit 40 to freely rotate and for a center of rotation of the magnet mounting unit 40 to be aligned with an axial center of the cylindrical portion 52, the cylindrical portion 52 may be formed in such a manner that a radius 52R of the inner end surface thereof is the same as or slightly greater than the sum of a radius of the annular body portion 44 of the magnet mounting unit 40 and a length of the saw-toothed protrusion 64, and a length 52L thereof is greater than a thickness of the annular body portion 44 of the magnet mounting unit 40 in the axial direction (arrow S) and smaller than a diameter of the annular body portion 44 of the magnet mounting unit 40.

Also, the accommodation unit 50 may further include an annular frame 54, which is provided on the outer end surface of the cylindrical portion 52 and has the opening portion 54*a*, through which the saw-toothed wheel 42 of the magnet mounting unit 40 is externally exposed, thereby preventing the separation of the magnet mounting unit 40.

An outer diameter of the annular frame 54 may be the same as an inner or outer diameter of the cylindrical portion so as to be connected to an edge of the cylindrical portion 52. The inner diameter of the annular frame 54 may be the same as or greater than an outer diameter of the saw-toothed wheel 42 of the magnet mounting unit 40 such that the saw-toothed wheel 42 of the magnet mounting unit 40 is fully exposed to the outside. Specifically, the inner diameter of the annular frame 54 may be the same as an outer diameter of the annular body portion 44 of the magnet mounting unit 40, such that the saw-toothed protrusion 64 provided on the magnet mounting unit 40 is hidden and the opening portion 54*a* is covered with the annular body portion 44 of the magnet mounting unit 40.

The accommodation unit 50 may further include a wedge portion 56 outwardly protruding from an end of the inner end surface of the cylindrical portion 52 to be stuck into the main body 20, such that the accommodation unit 50 is secured to the wooden main body 20. The wedge portion 56 may, of course, be formed in various shapes, in addition to the illustrated shape.

The accommodation unit 50 may further include a rib 58 protruding from an outer surface of the cylindrical portion 52, such that the accommodation unit 50 can be secured to the main body 20 more firmly so as not to be relatively rotated. The rib 58 may be provided in plurality, arranged with being spaced apart from one another along the circumferential direction of the cylindrical portion 52. The rib 58 may have a triangular shape that a length thereof protruding from the cylindrical portion 52 is gradually increased from the inner end surface toward the outer end surface of the cylindrical portion 52, thereby more surely preventing the separation of the cylindrical portion 52 from the main body 20.

The fine rotation-angle adjusting unit 60 may include a fine-adjustment saw-toothed wheel 62 formed on the annular frame 54 of the accommodation unit 50, arranged coaxially with the saw-toothed wheel 42 of the magnet mounting unit 40, and having toothed intervals smaller than those of the saw-toothed wheel 42 of the magnet mounting unit 40, and a saw-toothed protrusion 64 provided on the magnet mounting unit 40 and movable in engagement with the fine-adjustment saw-toothed wheel 62 along a circumferential direction of the fine-adjustment saw-toothed wheel 62.

Therefore, the fine rotation-angle adjusting unit 60 may allow the magnet mounting unit 40 to be relatively rotatable with respect to the accommodation unit 50. Specifically, the saw-toothed protrusion 64 may be relatively rotated by a fine angle every time of moving each saw-tooth of the fine-adjustment saw-toothed wheel 62, which may result in a fine adjustment of a rotation angle between toys.

The fine-adjustment saw-toothed wheel 62 may be formed in a finer size than the saw-toothed wheel 42 of the magnet mounting unit 40. This may facilitate the saw-toothed protrusion 64 to be rotated by weaker force when the saw-toothed protrusion 64 is rotated in engagement with the saw-toothed wheel 42 of the magnet mounting unit 40.

The saw-toothed protrusion 64 may be provided by one or in plurality. Preferably, for structural stability of the magnet mounting unit 40, the saw-toothed protrusion 64 may be provided in pair, arranged to face each other along a radial direction based on the center of rotation of the magnet mounting unit 40.

Meanwhile, the magnet-mounted part disclosed herein may further include a stopper 70 which limits a range that the magnet mounting unit 40 is rotated with respect to the accommodation unit 50, coaxially with the saw-toothed wheel 42.

That is, the stopper 70 may include stopping jaws 71, 72 73 and 74 provided in plurality, protruding from an inner surface of the annular frame 54 of the accommodation unit 50 with being spaced from one another along a circumferential direction, such that the saw-toothed protrusion 64 provided on the magnet mounting unit 40 can be stopped thereby. The stopping jaws 71, 72, 73 and 74 may have spaced intervals greater than the toothed intervals of the saw-toothed wheel 42 of the magnet mounting unit 40. Here, as the stopping jaws 71, 72, 73 and 74 of the stopper 70 are formed together with the fine-adjustment saw-toothed wheel 62 of the annular frame 54 of the accommodation unit 50, the saw-teeth of the fine-adjustment saw-toothed wheel 62 may be formed limitedly in a space between the stopping jaws 71, 72, 73 and 74 of the stopper 70.

The plurality of stopping jaws 71, 72, 73 and 74 may be provided in plural pairs in correspondence with the pair of saw-toothed protrusions 64 of the magnet mounting unit 40, and intervals between the pairs may be different. That is, each pair of stopping jaws 71, 72, 73 and 74 may be formed with 180° interval in correspondence with one pair of saw-toothed protrusions 64 of the magnet mounting unit 40, and each interval from one stopping jaw 71, 72, 73 and 74 to a neighboring stopping jaw 71, 72, 73 and 74 may be different, for example, 15°, 23°, 35°, 40° and the like. In this case, a relative rotation angle of the magnet mounting unit 40 with respect to the accommodation unit 50 may be changed according to between which stopping jaws 71, 72, 73 and 74 the saw-toothed protrusion 64 of the magnet mounting unit 40 is inserted.

The stopping jaws 71, 72, 73 and 74 may preferably have protruding lengths 70L, which are higher than toothed heights of the saw-toothed wheel 42 of the magnet mounting unit 40, such that the saw-toothed protrusion 64 of the magnet mounting unit 40 cannot get over the stopping jaws 71, 72, 73 and 74 while executing the relative rotation.

In such a manner, the magnet mounting unit 40 may be formed of various materials, preferably, synthetic resin, in the aspect of facilitation of an accurately fine processing, representation of various colors for giving a wood-like image and the like, a light weight, and so on.

A magnetic body 80 may be formed of a material, which attracts the magnet 10, and coupled to the accommodation unit 50. Accordingly, the open portion of the accommodation space 52*a* may be covered with the magnet mounting unit 40 such that the accommodation space 52*a* can be shielded even when toys are not assembled to each other.

The magnetic body 80 may be coupled to a circumferential surface of the opening portion 54*a* of the accommodation unit 50. In this case, the magnetic body 80 may directly attract the magnet 10 toward the opening portion 54*a* of the accommodation unit 50. This may facilitate the opening portion 54*a* of the accommodation unit 50 to be surely covered.

The magnetic body 80 may also face the magnet 10, so as to directly interact with the magnet 10. Also, the magnetic body 80 may be easily coupled to the accommodation unit 50 without interfering with an organic coupling relation between the accommodation unit 50 and the magnet mounting unit 40.

The magnetic body 80 may be accommodated in an accommodation recess 51, which is formed on the accommodation unit 50 and has a shape corresponding to that of the magnetic body 80.

The magnetic body 80 may advantageously be formed of a metal, such as iron, having high magnetism, and have an annular shape which is not limited in directionality and the like and enables an easy, strong interaction with the magnet 10.

That is, the magnetic body 80 may be implemented as a metallic ring. Specifically, a section of the metallic ring may be semicircular, and a flat surface 80*a* of the semicircle may be coupled to the accommodation unit 50 to come in contact with the magnet mounting unit 40. Accordingly, in terms of a size of the magnetic body 80, a wider coupling area may be ensured between the magnetic body 80 and the magnet mounting unit 40, resulting in increased interaction between the magnetic body 80 and the magnet 10.

Hereinafter, description will be given of an assembly between toys having the aforementioned magnet-mounted parts 30. It may be assumed and illustrated in the drawing that one toy serving as a basis (reference) is referred to as a first toy 2, and another toy assembled with the first toy 2 through the magnet-mounted part 30 is referred to as a second toy 4. The main bodies 20 of the first toy 2 and the second toy 4 may have the same shape or different shapes. However, the magnet-mounted parts 30 of the first toy 2 and the second toy 4 may be the same as each other.

When the first toy 2 and the second toy 4 are put together such that the magnet-mounted part 30 of the second toy 4 comes in contact with the magnet-mounted part 30 of the first toy 2, the magnet 10 of the first toy 2 and the magnet 10 of the second toy 4 may be attracted to each other by a magnetic force, namely, an attractive force, and additionally the saw-toothed wheel 42 of the first toy 2 and the saw-toothed wheel 42 of the second toy 42 may be engaged with each other.

Figure 5:
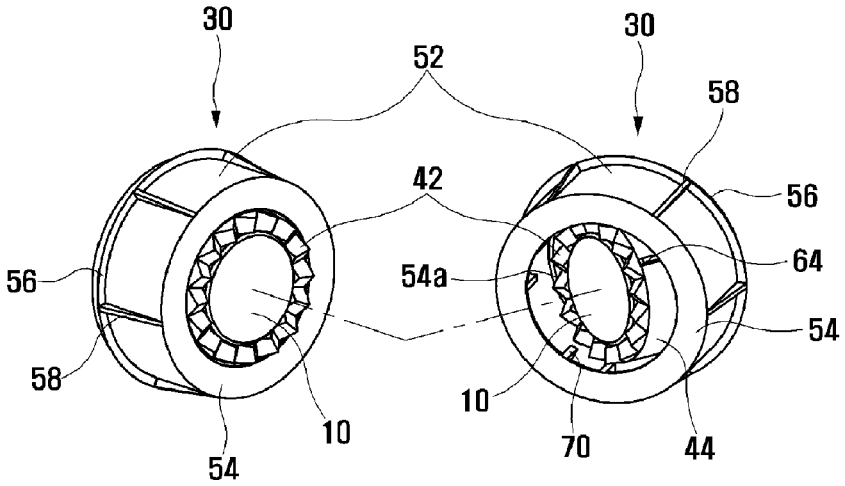
FIG. 5 is a perspective view illustrating a magnetic force-based interaction between magnets mounted to the magnet-mounted part.

Here, when the magnet 10 of the first toy 2 and the magnet 10 of the second toy 4 are put together by the magnetic force, specifically, as illustrated in FIG. 5, the magnet mounting unit 40 of the first toy 2 and the magnet mounting unit 40 of the second toy 4 may be turned over within the accommodation unit 50 in a rotating manner such that the attractive force can be applied between the magnet 10 of the first toy 2 and the magnet 10 of the second toy 4. The magnet mounting unit 40 of the first toy 2 and the magnet mounting unit 40 of the second toy 4 may be pulled toward the outer end surface of the accommodation unit 50 by the magnetic force, such that the saw-toothed protrusion 64 of the magnet mounting unit 40 can be engaged with saw-teeth of the fine-adjustment saw-toothed wheel 62 of the accommodation unit 50, which are located between the stopping jaws 71, 72, 73 and 74.

Accordingly, the assembled state between the first toy 2 and the second toy 4 can be maintained by the magnet force of the magnets 10. The engagement of the saw-tooth wheels 42 may allow the centers of the magnets 10 of the first toy 2 and the second toy 4 to be aligned with each other and prevent slipping, relative rotation and the like between the first toy 2 and the second toy 4.

In addition, while the saw-tooth wheels 42 of the first and second toys 2 and 4 are engaged with each other, the second toy 4 may be relatively rotated with respect to the first toy 2. Accordingly, contact surfaces between the first toy 2 and the second toy 4 may be aligned with each other to prevent the assembled position of the first and second toys 2 and 4 from being zigzag (misaligned). This may allow the first toy 2 and the second toy 4 to come into alignment with each other, thereby improving assembly completion of the first and second toys 2 and 4. Also, the engagement process of the saw-toothed wheels 42 of the first and second toys 2 and 4 may result in scientific learning, which may increase creativities of infants. In addition, a frictional sound generated in response to the engagement between the saw-toothed wheels 42 of the first toy 2 and the second toy 4 may stimulate those infants' auditory senses, resulting in improving the infants' interests and inventive ability.

Hereinafter, description will be given in detail of the rotation of the first toy 2 and the second toy 4 while the saw-toothed wheels 42 thereof are engaged with each other, with reference to FIG. 6 and the following drawings.

Figure 6:
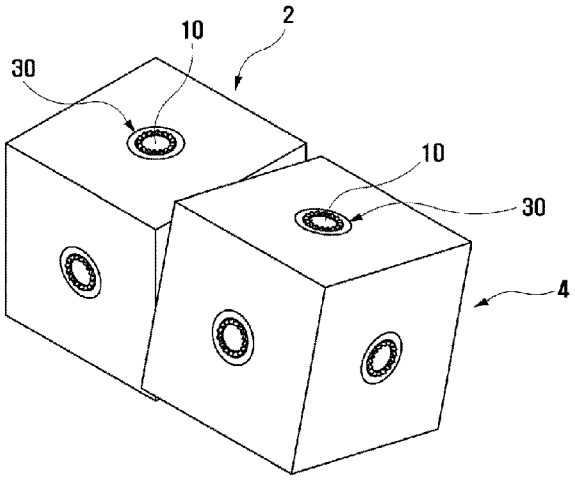
FIG. 6 is a perspective view illustrating an initially assembled state of a first toy and a second toy.
Figure 7:
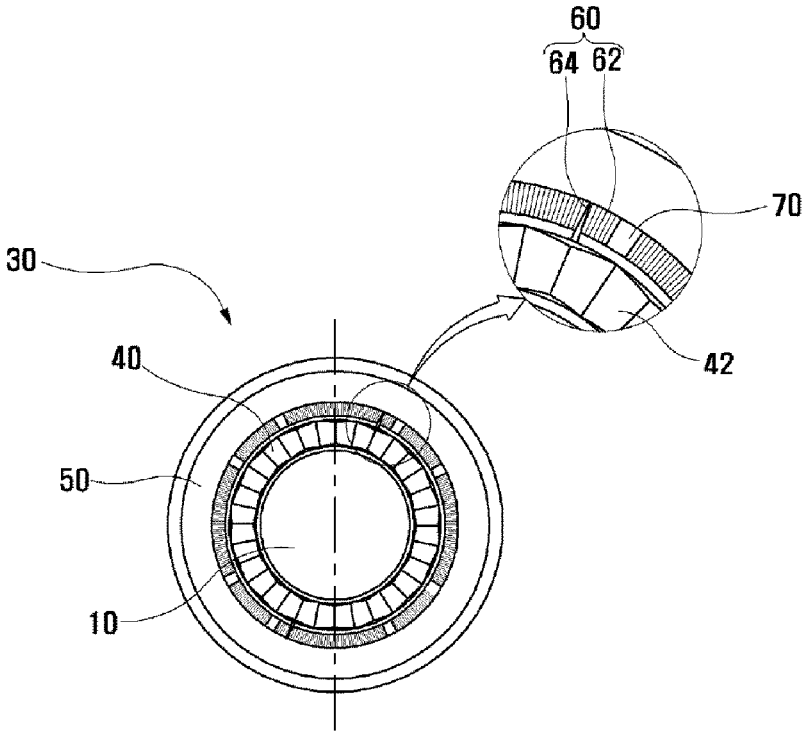
FIG. 7 is a planar view illustrating an assembled state of the magnet-mounted part of FIG. 6.
Figure 8:
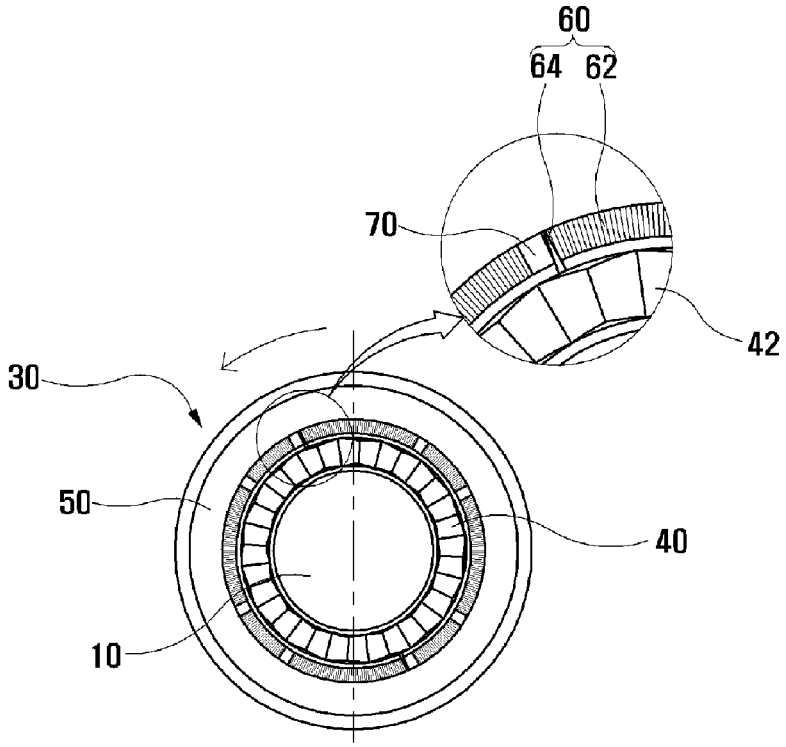
FIG. 8 is a planar view illustrating a relatively-rotated state of the magnet mounting unit with respect to an accommodation unit from the state of FIG. 7.

As illustrated in FIGS. 6 and 7, while the saw-toothed wheels 42 of the first toy 2 and the second toy 4 are engaged with each other, when the second toy 4 is relatively rotated with respect to the first toy 2, if the saw-toothed protrusions 64 provided on each magnet mounting unit 40 of the first toy 2 and the second toy 4 are not in a stopped state by the stopping jaws 71, 72, 73 and 74, the saw-toothed wheels 42 of the first toy 2 and the second toy 4, as illustrated in FIG. 8, may be integrally rotated in engagement with each other. Accordingly, each of the magnet mounting units 40 of the first toy 2 and the second toy 4 may be relatively rotated with respect to each accommodation unit 50. Here, a relative rotation between the main bodies 20 of the first toy 2 and the second toy 4 may not be generated.

Figure 9:
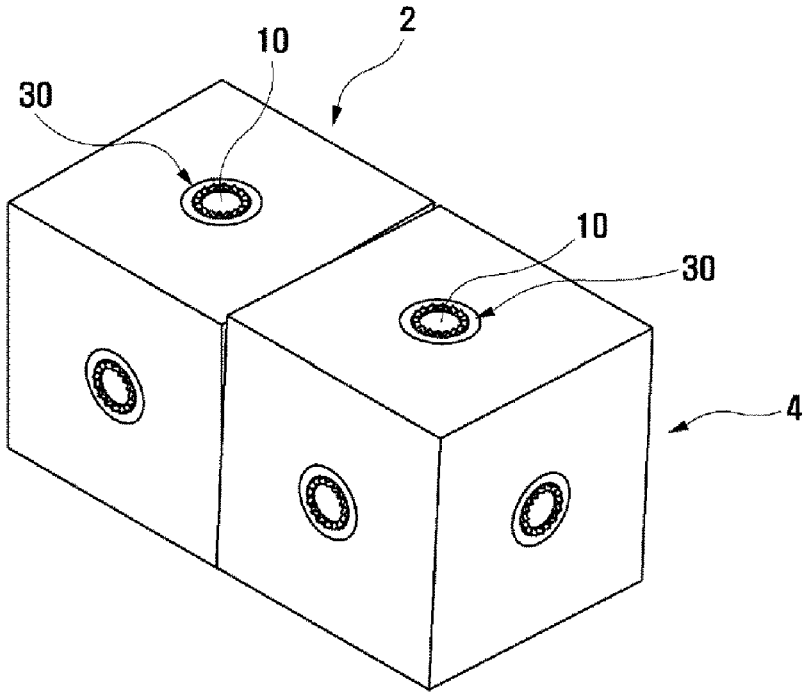
FIG. 9 is a perspective view illustrating a first (primary) aligned state according to an operation of saw-toothed wheels of the first toy and the second toy.
Figure 10:
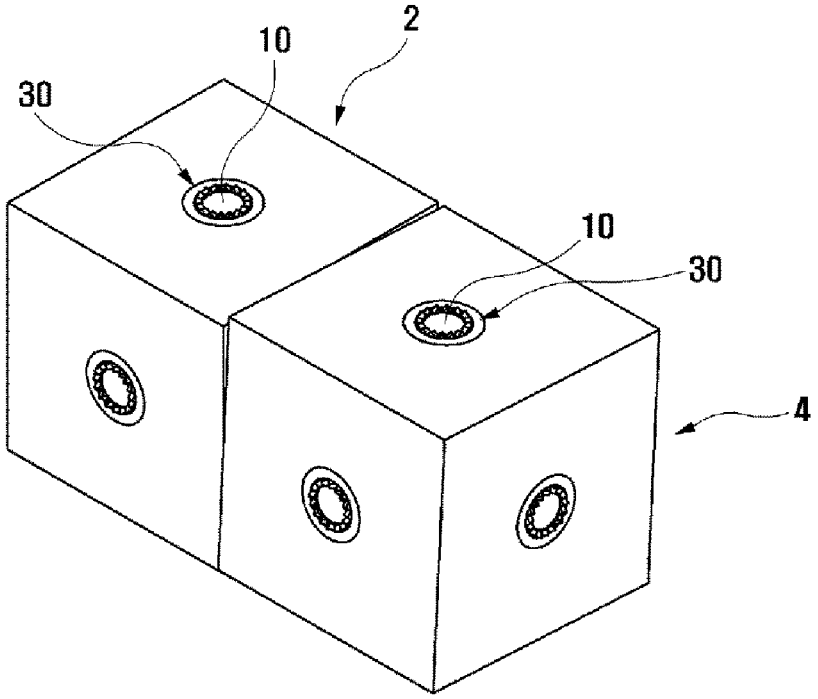
FIG. 10 is a planar view illustrating an assembled state of the magnet-mounted part of FIG. 9.

When the saw-toothed protrusions 64 provided on each magnet mounting unit 40 of the first toy 2 and the second toy 4 are stopped at the stopping jaws 71, 72, 73 and 74 of each accommodation unit 50, as illustrated in FIG. 8, since each magnet mounting unit 40 of the first toy 2 and the second toy 4 can be integrally rotated with each accommodation unit 50, the saw-toothed wheel 42 of the second toy 4 may be relatively rotated with respect to the saw-toothed wheel 42 of the first toy 2, as illustrated in FIGS. 9 and 10. Consequently, the second toy 4 may be relatively rotated with respect to the first toy 2 such that the first toy 2 and the second toy 4 can be aligned with each other.

Here, a rotation angle unit by the saw-toothed wheel 42 of the magnet mounting unit 40 may be decided according to an interval between saw-teeth. For instance, when the interval between the saw-teeth is 5°, each rotation may be executed by 5° by the saw-toothed wheel 42 of the magnet mounting unit 40. Accordingly, a rotation angle adjustment below 5° may be unable by the saw-toothed wheel 42 of the magnet mounting unit 40. That is, when the second toy 4 is misaligned with the first toy 2 by an angle below 5°, it may be difficult to achieve the rotation angle adjustment by the engagement between the saw-toothed wheels 42 of the first toy 2 and the second toy 4, which may disable a fine alignment thereof.

Figure 11:
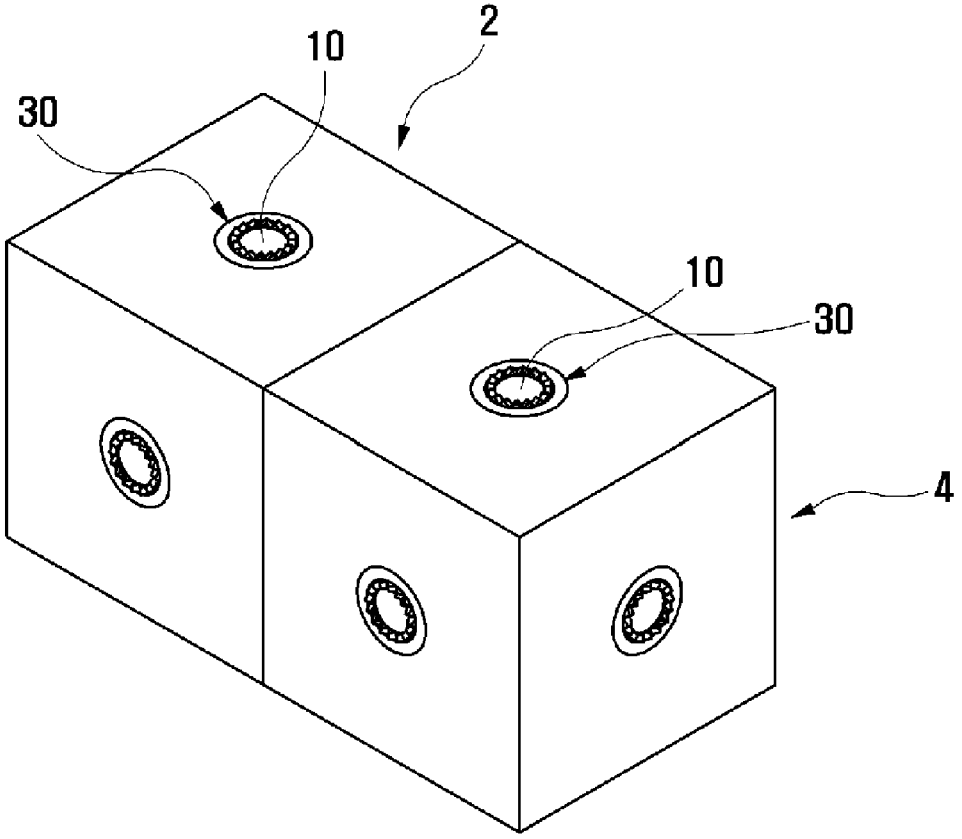
FIG. 11 is a perspective view illustrating a second (secondary, final) aligned state according to the operation of the saw-toothed wheels of the first toy and the second toy.
Figure 12:
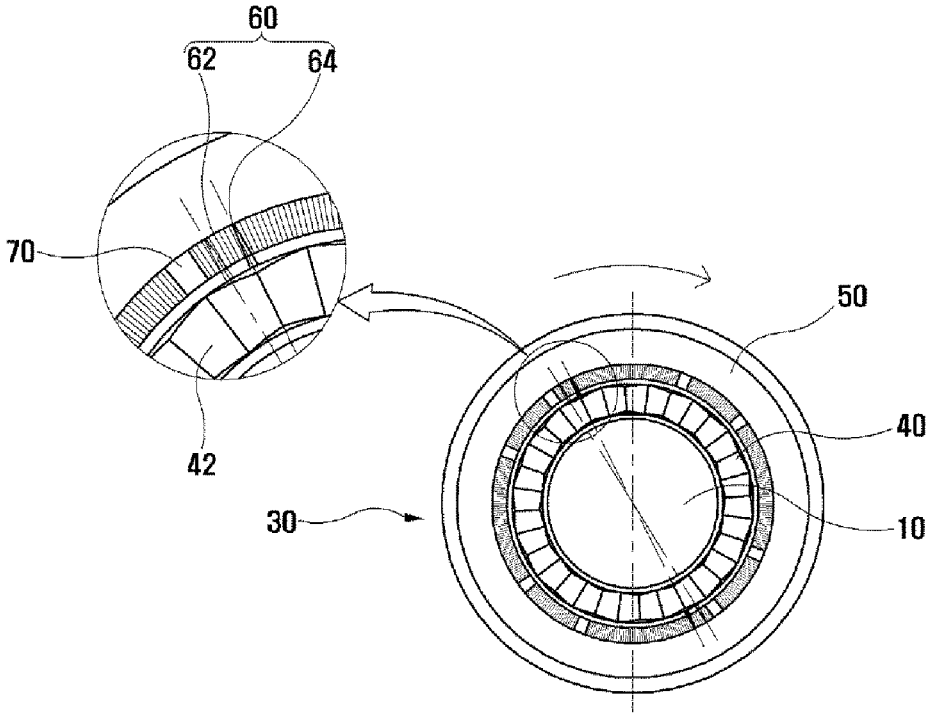
FIG. 12 is a planar view illustrating an assembled state of the magnet-mounted part of FIG. 11.

However, each magnet mounting unit 40 of the first toy and the second toy 4 may be relatively rotatable with respect to each accommodation unit 50. Accordingly, while the alignment between the first toy 2 and the second toy 4 is almost achieved by the engagement between the saw-toothed wheels 42 of the first toy 2 and the second toy 4 as illustrated in FIGS. 9 and 10, when the first toy 2 or the second toy 4 is rotated in an opposite direction to the rotation direction of the engaged saw-toothed wheels 42 of the first toy 2 and the second toy 4 as illustrated in FIGS. 11 and 12, the saw-toothed protrusions 64 provided on the magnet mounting unit 40 of the first or second to 2 or 4 may be relatively rotated in a direction of being spaced apart from the stopping jaws 71, 72, 73 and 74 of the accommodation unit 50 in engagement with the fine-adjustment saw-toothed wheel 62. This may allow for more relative rotation of the first toy 2 and the second toy 4, resulting in alignment of the first toy 2 and the second toy 4. Here, the relative rotation of the first toy 2 and the second toy 4 may be adjusted by the toothed intervals of the fine-adjustment saw-toothed wheel 62. For example, if the toothed interval of the fine-adjustment saw-toothed wheel 62 is 1°, the magnet mounting unit 40 may be relatively rotated by 1° for each time with respect to the accommodation unit 50, thereby allowing for the fine rotation angle adjustment.

Therefore, the assembly completion of the first toy 2 and the second toy 4 may be improved.

Specifically, the magnet-mounted part 30 disclosed herein may more effectively increase the assembly completion when the main body 20 of the magnet toy is implemented as a polygonal block, such as hexagonal shape, so as to have a great influence on assembly completion.

The preferred embodiment disclosed herein is merely illustrative, without limiting the scope of the present disclosure. Also, variation or modification of the embodiment may be allowed within the scope of claims of the present disclosure.

What is claimed is:

1. A magnet-mounted part, comprising:

a magnet mounting unit, wherein a magnet is to be mounted in the magnet mounting unit and wherein the magnet mounting unit comprises:

an annular body portion having a central space for mounting the magnet therein, and one or more saw-toothed wheels that are formed on or coupled to the annular body portion;

an accommodation unit, wherein the accommodation unit is configured to accommodate the magnet mounting unit, wherein the annular body portion is rotatable within the accommodation unit by an attractive force of the magnet, and wherein the accommodation unit comprises an opening portion that is configured to expose at least one of the one or more saw-toothed wheels of the magnet mounting unit; and a fine rotation angle-adjusting unit, wherein the fine rotation angle-adjusting unit is configured to rotate in engagement with the magnet mounting unit and the accommodation unit and wherein the fine rotation angle-adjusting unit is formed such that one or more unit rotation intervals of the fine rotation angle-adjusting unit are smaller than one or more toothed intervals of the one or more saw-toothed wheels of the magnet mounting unit.

2. The magnet-mounted part of claim 1, wherein the annular body portion of the magnet mounting unit is formed in an annular shape having a center for the magnet to be mounted therein, wherein the one or more saw-toothed wheels are formed on or coupled to at least one of a plurality of end surfaces of the annular body portion along an axial direction, and wherein the magnet mounting unit has a size large enough that the plurality of end surfaces are turned over in an accommodation space of the accommodation unit when the annular body portion is rotated.

3. The magnet-mounted part of claim 2, wherein the accommodation unit further comprises:

a cylindrical portion, wherein the cylindrical portion has a shape that corresponds to the shape of the annular body portion of the magnet mounting unit; and an annular frame, wherein the annular frame is disposed on an end surface of the cylindrical portion and wherein annual frame has the opening portion.

4. The magnet-mounted part of claim 3, wherein the fine rotation angle-adjusting unit further comprises:

a fine adjustment saw-toothed wheel that is formed on the annular frame of the accommodation unit, and a saw-toothed protrusion that is disposed on the magnet mounting unit so as to be movable in engagement with the fine adjustment saw-toothed wheel along a circumferential direction of the fine adjustment saw-toothed wheel.

5. The magnet-mounted part of claim 3, wherein the accommodation unit further comprises:

a plurality of ribs that protrude from an outer surface of the cylindrical portion along a circumferential direction, the plurality of ribs being spaced apart from one another.

6. The magnet-mounted part of claim 1, wherein the fine rotation angle-adjusting unit further comprises:

a fine-adjustment saw-toothed wheel that is formed on the accommodation unit and arranged coaxially with at least one of the one or more saw-toothed wheels of the magnet mounting unit, and a saw-toothed protrusion that is provided on the magnet mounting unit and movable in engagement with the fine-adjustment saw-toothed wheel along a circumferential direction of the fine-adjustment saw-toothed wheel.

7. The magnet-mounted part of claim 1, further comprising:

a stopper that is configured to limit a range that the magnet mounting unit is rotated with respect to the accommodation unit.

8. The magnet-mounted part of claim 7, wherein the stopper further comprises:

one or more stopping jaws that protrude from the accommodation unit, wherein one or more saw-toothed protrusions of the magnet mounting unit are inserted between the one or more stopping jaws and wherein the one or more stopping jaws have intervals therebetween that are greater than the one or more toothed intervals of the one or more saw-toothed wheels of the magnet mounting unit.

9. The magnet-mounted part of claim 8, wherein at least two of the one or more saw-toothed protrusions disposed on the magnet mounting unit are provided as a pair facing each other based on a center of rotation, wherein at least two of the one or more stopping jaws are provided as a pair in correspondence with the pair of saw-toothed protrusions, and wherein intervals between the pairs of the stopping jaws are different from one another.

10. The magnet-mounted part of claim 8, wherein the fine rotation angle-adjusting unit further comprises:

at least one fine-adjustment saw-toothed wheel that is formed between the one or more stopping jaws, wherein the at least one fine-adjustment saw-toothed wheel is disposed on the accommodation unit and arranged coaxially with the one or more saw-toothed wheels of the magnet mounting unit.

11. The magnet-mounted part of claim 1, further comprising:

a magnetic body formed of a material attracting the magnet, wherein an open portion of an accommodation space of the accommodation unit is covered by the magnet mounting unit and wherein the magnetic body is coupled with the accommodation unit.

12. The magnet-mounted part of claim 11, wherein the magnetic body is implemented as a metallic ring.

13. The magnet-mounted part of claim 12, wherein the metallic ring has a semi-circle section and wherein a flat surface of the semi-circular section is coupled to the accommodation unit so as to come in contact with the magnet mounting unit.

14. The magnet-mounted part of claim 11, wherein the accommodation unit further comprises:

an accommodation recess formed to correspond to the magnetic body such that the magnetic body is accommodated therein.

15. The magnet-mounted part of claim 11, wherein the magnetic body is coupled to a circumferential surface of the opening portion as an open portion of the accommodation space.

16. A magnet toy, comprising:

a magnet-mounted part, comprising:

a magnet mounting unit, wherein a magnet is to be mounted in the magnet mounting unit-and wherein the magnet mounting unit comprises:

an annular body portion having a central space for mounting the magnet therein, and one or more saw-toothed wheels that are formed on or coupled to the annular body portion;

an accommodation unit, wherein the accommodation unit is configured to accommodate the magnet mounting unit, wherein the annular body portion is rotatable within the accommodation unit by an attractive force of the magnet and wherein the accommodation unit comprises an opening portion that is configured to expose at least one of the one or more saw-toothed wheels of the magnet mounting unit; and a fine rotation angle-adjusting unit, wherein the fine rotation angle-adjusting unit is configured to rotate in engagement with the magnet mounting unit and the accommodation unit and wherein the fine rotation angle-adjusting unit is formed such that one or more unit rotation intervals of the fine rotation angle-adjusting unit are smaller than one or more toothed intervals of the one or more saw-toothed wheels of the magnet mounting unit; and a main body having at least one part-installation recess in which the magnet-mounted part is inserted.

17. The magnet toy of claim 16, wherein the main body is implemented as a polygonal block.

18. The magnet toy of claim 16, wherein the accommodation unit of the magnet-mounted part further comprises:

a wedge portion outwardly protruding from an end surface of the cylindrical portion to be stuck into the main body.

* * * * *